US006341995B1

(12) United States Patent
Lai et al.

(10) Patent No.: US 6,341,995 B1
(45) Date of Patent: Jan. 29, 2002

(54) CHEMICAL MECHANICAL POLISHING APPARATUS

(75) Inventors: Chien-Hsin Lai; Juen-Kuen Lin, both of Kaohsiung; Jung-Nan Tseng, Chu-Pei; Huang-Yi Lin, Tai-Ping; Kevin Yu, Hsin-Chu, all of (TW)

(73) Assignee: United Microelectronics Corp. (TW)

( * ) Notice: Subject to any disclaimer, the term of this patent is extended or adjusted under 35 U.S.C. 154(b) by 0 days.

(21) Appl. No.: 09/522,488

(22) Filed: Mar. 10, 2000

(51) Int. Cl.[7] ..... B24B 49/00

(52) U.S. Cl. ..... 451/6; 451/41; 451/283

(58) Field of Search ..... 451/6, 41, 283, 451/285

(56) References Cited

U.S. PATENT DOCUMENTS 6,042,455 A * 3/2000 Togawa et al.
6,159,073 A * 12/2000 Wiswesser et al.
6,190,234 B1 * 2/2001 Swedek et al.
6,196,904 B1 * 3/2001 Matsuo et al.

* cited by examiner

*Primary Examiner*—Joseph J. Hail, III
*Assistant Examiner*—Willie Berry, Jr.
(74) *Attorney, Agent, or Firm*—Powell, Goldstein, Frazer & Murphy, LLP

(57) ABSTRACT

The present invention relates to improved chemical mechanical polishing apparatus, which reduce air sharp pressure on the polish head for preventing the breakage unpolished wafer. The improved chemical mechanical polishing apparatus of present invention is composed of a wafer head, a polish head, a damper and a sensor. The flowing speed of gas is reduced by making the diameter of the gas line connected to the damper air inlet smaller than the diameter of the gas line connected to the damper air outlet. The initial air sharp pressure is reduced and make $\Delta P = P_{wafer} - P_{polish} < 0$, by adding an air temporary storage machine in between the inlet and the outlet. Besides, putting a sensor on the air lines under the air temporary storage machine, when slurry flows in the air line owing to the breaking of slurry diaphragm, the sensor will send a signal to a control system of the improved apparatus of chemical mechanical polishing, and make the related parts stop operating automatically to avoid breaking.

13 Claims, 4 Drawing Sheets

CHEMICAL MECHANICAL POLISHING APPARATUS

BACKGROUND OF THE INVENTION

1. Field of the Invention

The present invention relates generally to an apparatus of chemical mechanical polishing (CMP), and more particularly to, an improved apparatus of chemical mechanical polishing, which reduces air sharp pressure on the polish head for preventing the breakage of unpolished wafers.

2. Description of the Prior Art

Chemical mechanical polishing (CMP) is the only technology, which can provide a total planarization for ULSI process. This technology comes from IBM company and has been developed through many decades, and been already applied on many products, such as central processing unit (CPU). The philosophy is the planarization technique that uses a "knife grinder" like mechanical polishing method and in accompanies with a proper chemical reagent to planarize the rough sketch on wafer surface. Once all parameters are controlled well, chemical mechanical polishing can offer a smooth degree of more than 94%. Therefore, semiconductor manufacturers and the suppliers of facilities and chemicals all over the world are continually investing the development of CMP technology.

Referring to FIG. 1, which indicates a partial structural drawing the conventional traditional chemical mechanical polishing apparatus 10 which is composed of a wafer head 110, and a polish head 120. Wafer head 110 includes a wafer air inlet 112, a carrier firm 114 and a wear ring 116. Polish head 120 includes a polish air inlet 122, a polish air outlet 124, a pad air inlet 126 and a slurry diaphragm 128. When an unpolished wafer 118 is placed on the wafer head 110, the carrier firm 114 is put smoothly on the unpolished wafer 118, which is composed of high molecule polymerization, for example, plastic, rubber . . . etc, and then pouring in air from the wafer air inlet 112. The air pressure on the wafer head 110 is $P_{wafer}$, which is being pressed uniformly on the unpolished wafer 118 through the carrier firm 114, and the function of the wear ring 116 is to prevent the unpolished wafer 118 from slipping out from the wafer head 110 to break. Then, to pour air into the wafer air inlet 122 and the air will press uniformly on the slurry diaphragm 128, which is composed of high molecule polymerization, such as plastic, rubber . . . etc, and then leave from the polish air outlet 124. The air pressure on polish head 120 is $P_{polish}$. Especially to take notice on the difference between $P_{wafer}$ and $P_{polish}$, which should be negative (it means $\Delta P=P_{wafer}-P_{polish}<0$). By means of letting $P_{polish}$ to be greater than $P_{wafer}$ unpolished wafer 118 can stick on the carrier firm 114 to process polishing. When the difference is positive (It means $\Delta P=P_{wafer}-P_{polish}>0$), the unpolished wafer 118 can't stick on the carrier firm 114, and the unpolished wafer 118 will slip out the wear ring 116 and break. Besides, when polishing pad directly polishes the surface of the unpolished wafer 118, not only the slurry diaphragm 128 will release slurry to increase efficiently, but also the pad air inlet 126 will pour in air to maintain the system operation balance.

A partial air pressure regulation system is illustrated in FIG. 2. When air goes into the polish head 120 (through an air supply line 132), it needs to pass a regulator E/P first. Because the air pressure controlling system (not shown in Figure) must change way to send signal from digital to analog through this regulator and to adjust air pressure from the polish head 120. When the air leave the polish head 120 through another air line 134, it needs to pass a second polish pressure transducer P/I 138, which functions to change signal from analog to digital and to send back to air pressure control system. It owes to adjust air pressure through the wafer head 120.

But when pouring air to process chemical mechanical polishing, no matter the wafer air inlet 112, the polish air inlet 122 or the pad air inlet 126, the air pressure curves will all be the one illustrated in FIG. 3. The curve first show some time a sharp pressure, and gradually become air pressure steady state. In sharp pressure condition, due to the curve range of air pressure is huge:

(1) When $P_{wafer}$ on the top point of the sharp pressure, and $P_{polish}$ is on the low point, it will increase the probability of $\Delta P=P_{wafer}-P_{polish}>0$, and the unpolished wafer 118 will slip out the wear ring 116 and break.

(2) When the pressure difference between $P_{wafer}$ and $P_{polish}$ is too huge, it will cause slurry diaphragm 128 to break. In polishing process, slurry flows into the polish air inlet 122/outlet 124 from break and flows through the air supply line 132, 134 to the first regulator E/P 136, the second regulator E/P 138. It will make the real air pressure not be detected, and will send out a wrong signal to the air pressure control system. It will cause error on adjustment of air pressure, $\Delta P=P_{wafer}-P_{polish}>0$, and make unpolished wafer 118 slip out the wear ring 116 and break.

SUMMARY OF THE INVENTION

In accordance with the present invention, an improved chemical mechanical polishing apparatus is provided for processing chemical mechanical polishing that substantially overcomes drawbacks of above mentioned problems aroused form the conventional methods.

Accordingly, it is an object of the present invention to provide an improved chemical mechanical polishing apparatus which can reduce the sharp pressure and the probability of $\Delta P=P_{wafer}-P_{Polish.}>0$.

Another object of the present invention is to provide an improved chemical mechanical polishing apparatus that can detect whether slurry flows from the broken point of diaphragm to air supply line or not.

This invention is related to an improved chemical mechanical polishing apparatus, which is composed of a wafer head, a polish head, a damper and a sensor. The flowing speed of gas is reduced by making the diameter of the gas line connected to the damper air inlet smaller than the diameter of the gas line connected to the damper air outlet. The initial air sharp pressure is reduced and make $\Delta P=P_{wafer}-P_{polish}<0$, by adding an air temporary storage machine in between the inlet and the outlet. It means that an unpolished wafer can stick on the carrier firm and won't slip out to break when polishing. Besides, putting a sensor on the air lines under the air temporary storage machine, when slurry flows in the air line owing to the breaking of slurry diaphragm, the sensor will send a signal to a control system of the improved apparatus of chemical mechanical polishing, and make the related parts stop operating automatically to avoid breaking.

DESCRIPTION OF THE PREFERRED EMBODIMENT

Figure 1:
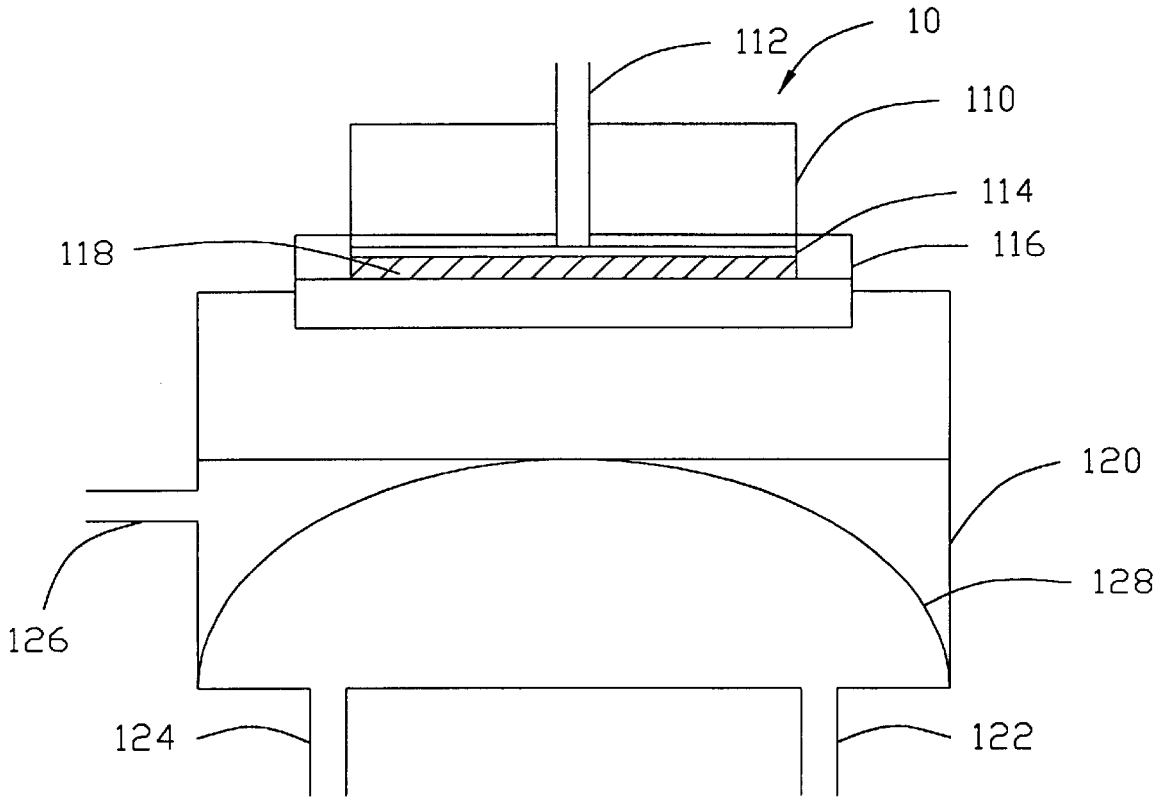
FIG.1(Prior Art)
FIG. 1 shows a portion of structure in the conventional chemical mechanical polishing apparatus.
Figure 2:
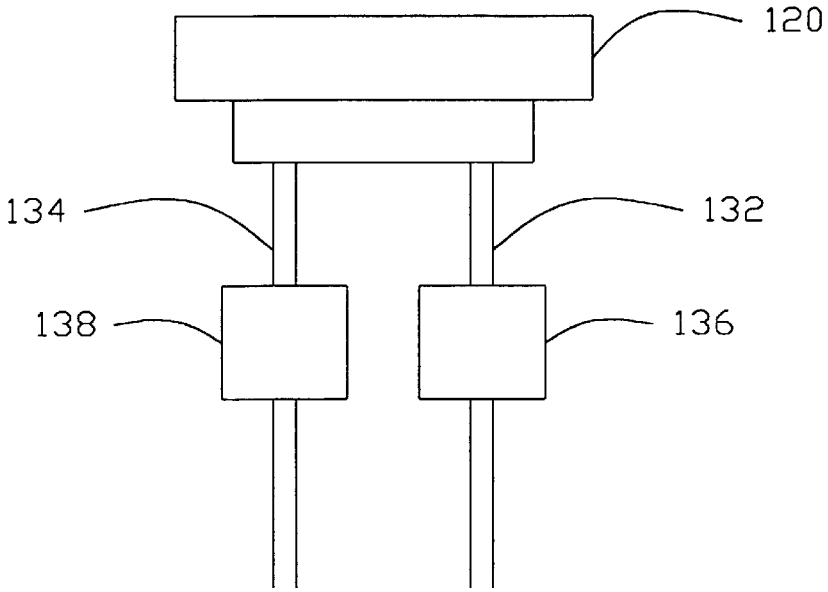
FIG.2(Prior Art)
FIG. 2 shows a portion of air pressure regulation system in the conventional chemical mechanical polishing apparatus.
Figure 3:
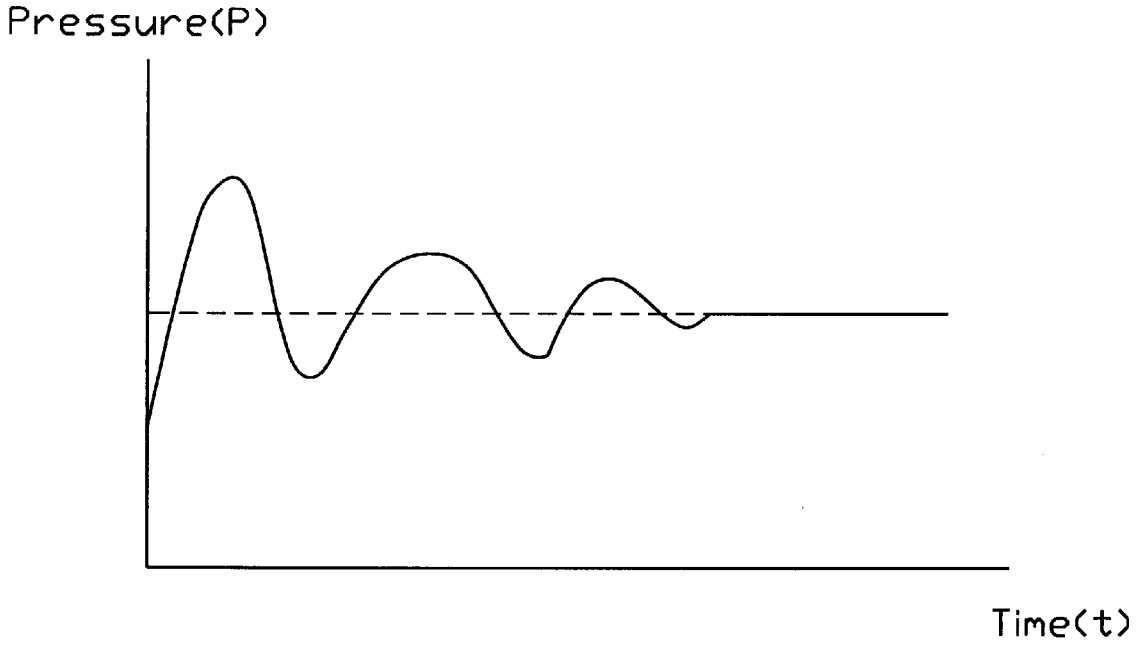
FIG.3(Prior Art)
FIG. 3 shows a pressure curve of entering air into the conventional chemical mechanical polishing apparatus.
Figure 4:
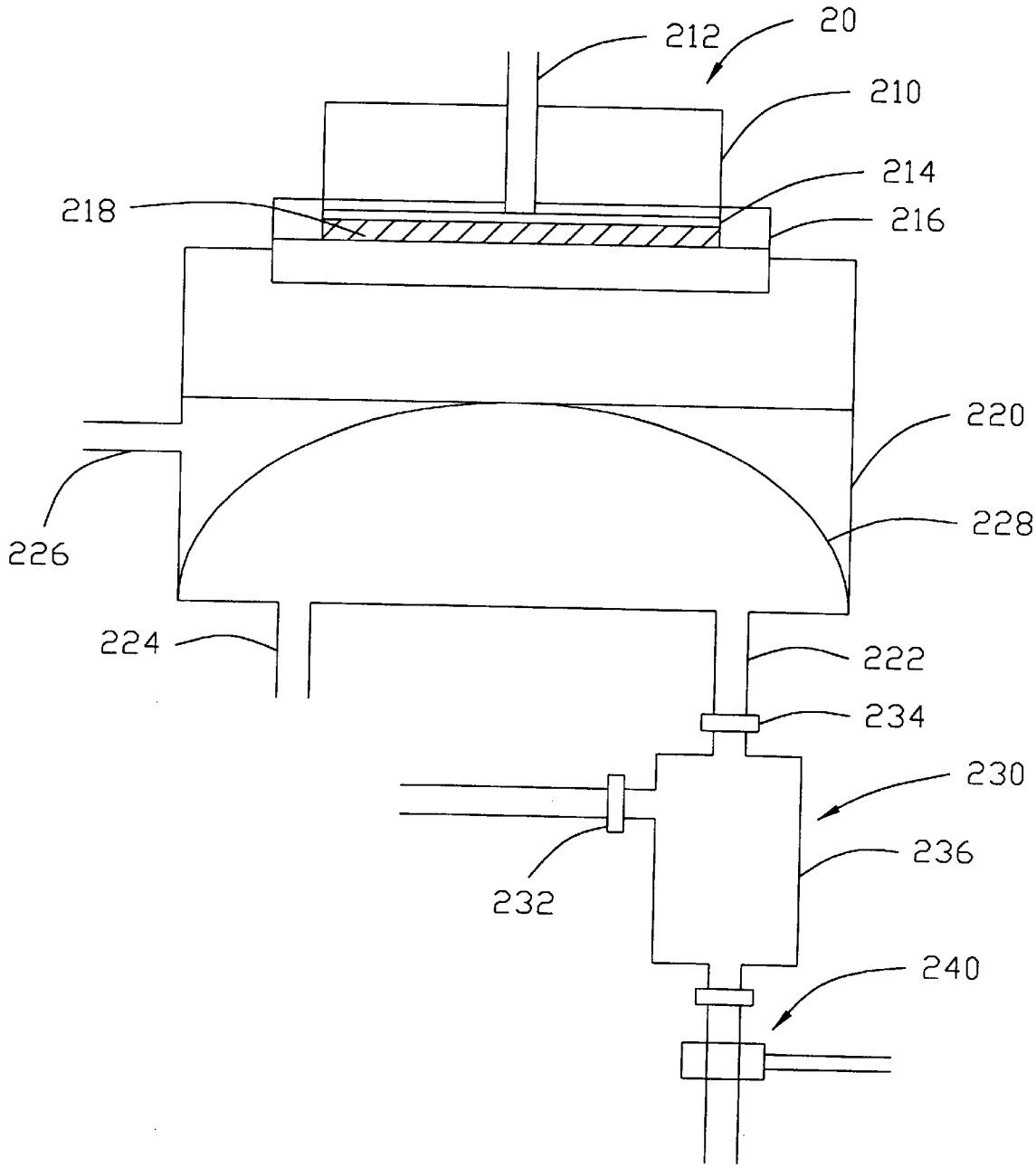
FIG. 4 shows a portion of structure in the improved chemical mechanical polishing apparatus of present invention.

As illustrated in FIG.4, and in accordance with the partial structure drawing of an improved chemical mechanical polishing 20 been disclosed by the specification. The apparatus is composed of a wafer head 210 for installing an unpolished wafer, a polish head 220 for providing slurry to the surface of the wafer, a damper 230 which is connected to an air inlet of the polish head for reducing the air sharp pressure curve, and a sensor 240 which is connected to an air inlet or outlet of the polish head or damper for detecting an unusual flowing liquid. Wafer head 210 includes a wafer air inlet 212, a carrier firm 214, and a wear ring 216. Polish head 220 includes a polish air inlet 222, a polish air outlet 224, a pad air inlet 226, and a slurry diaphragm 228. Damper 230 includes a damper air inlet 232 a damper air outlet 234 and an air temporary storage machine 236. Sensor 240 includes emitter 242 and a receiver 244.

When the unpolished wafer 218 is placed on the wafer head 210, the carrier firm 214 is put smoothly on the unpolished wafer 218, which is composed of high molecule polymerization, for example, plastic, rubber . . . etc, and then pouring in air from the wafer air inlet 212. The air pressure on the wafer head 210 is $P_{wafer}$, which is pressed uniformly on the unpolished wafer 218 through the carrier firm 214. The function of the wear ring 216 is to prevent the unpolished wafer 218 from slipping out from the wafer head 210 to break. Then, to pour air into the polish air inlet 222, and the air will press uniformly on the slurry diaphragm 228, and then leave from the polish air outlet 224. The air pressure on the wafer head 220 is $P_{polish}$. The difference between $P_{wafer}$ and $P_{polish}$ is negative, it means that $\Delta P=P_{wafer}-P_{polish}<0$. By means of letting $P_{wafer}$ to be greater then $P_{polish}$ can make the unpolished wafer 218 stick on the carrier firm 214 for polishing. Besides, when polishing the unpolished wafer 218, the slurry diaphragm 228 will release slurry for polishing the unpolished wafer 218 more efficiently. Simultaneously, the pad air inlet 226 will also pour in air for maintaining the system operation balance.

Figure 5:
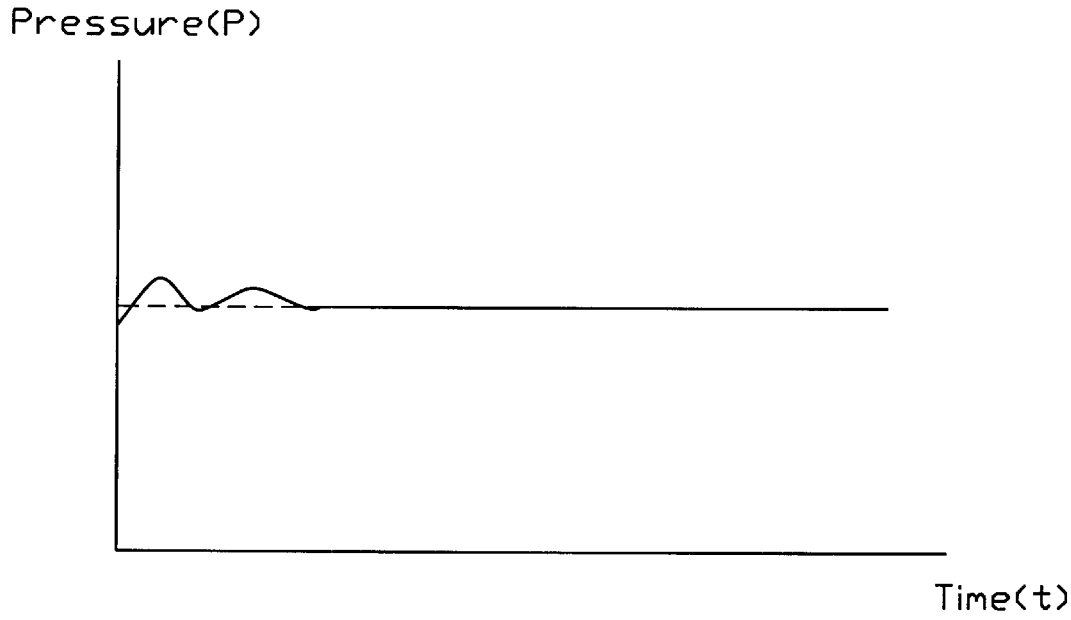
FIG. 5 shows a show a pressure curve of entering air into the conventional chemical mechanical polishing apparatus.

FIG. 4. and FIG. 5. will be used in conjunction for detail structure and the operation principle of the damper 230. When air flows into the air temporary storage machine 236 from the damper air inlet 232 and leaves from the damper air outlet 234, the air flowing speed will be reduced. That is because the radius of the line which is connected to the damper air inlet 232, for example ¼ inches, is smaller than the radius of the line which is connected to the damper air outlet 234, for example ⅜ inches. According to the principle of hydromechanics, when air flows from a smaller transverse area to a bigger transverse area, the speed will slow down, and it can reduce the initial air sharp pressure curve. Moreover, the improved chemical mechanical polishing apparatus 20 of the present invention further includes the air temporary storage machine 236 between the damper air inlet 232 and the damper air outlet 234. Thus, the $\Delta P=P_{wafer}-P_{polish}>0$ can be reduced in a more effective way. It also means that the unpolished wafer 218 can stick on the carrier firm 214 to process polishing and it will not break due to slip out from the wear ring 216.

Besides, according to real condition, the damper 230 can also be placed on any air line, for example, on the wafer air inlet 212, the pad air inlet 226 . . . etc. Furthermore, in order to avoid a greater pressure difference between $P_{wafer}$ and $P_{polish}$ for causing breakage on the slurry diagram 228, slurry flows from the breaking point to the polish air inlet 222/outlet 224, and flows along an air supply line to the first regulator E/P and the second polish pressure transducer P/I. The real air pressure will not be detected, and a wrong signal will be send out to the air pressure control system to cause a wrong air pressure adjustment. $\Delta P=P_{wafer}-P_{polish}>0$ will happen and unpolished wafer will slip out the wear ring 216 and break.

Figure 6A:
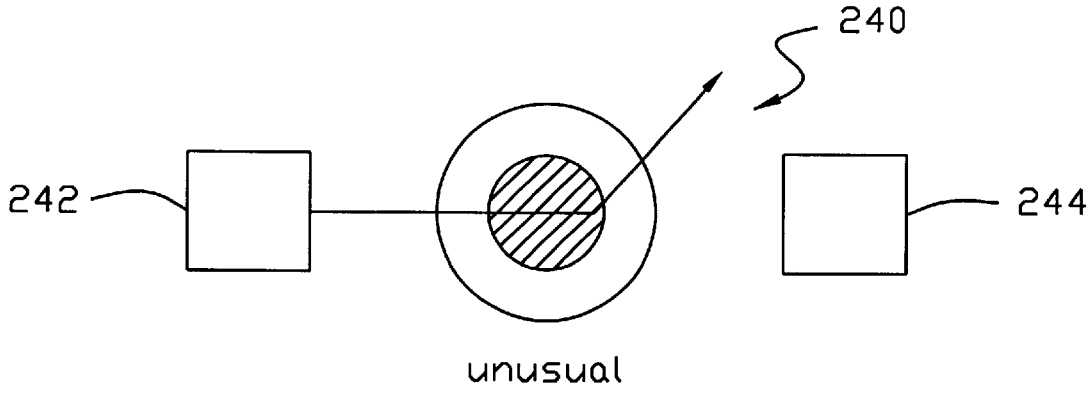
FIGS. 6A to 6B shows the operation principle of the sensor in the improved chemical mechanical polishing apparatus of present invention.
Figure 6B:
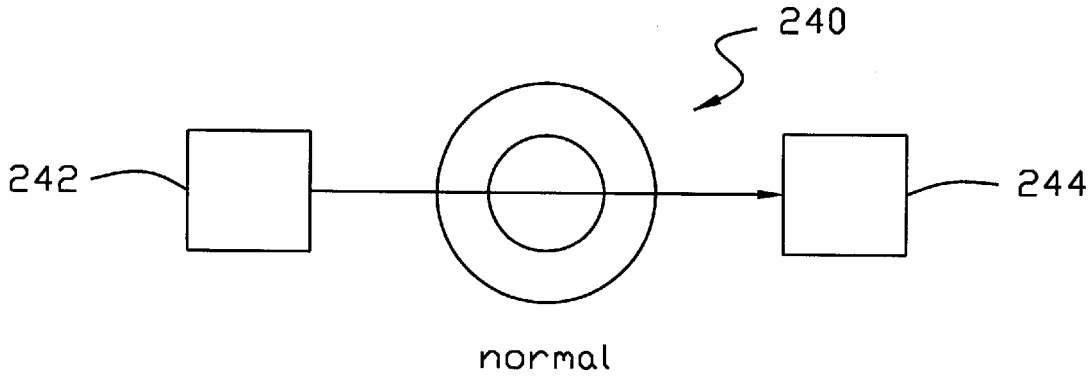

The present invention installs a sensor 240 on an air line 238 under the air temporary storage machine 236. As illustrated in FIG. 6, when light emits from an emitter 242, normally, it should go through air directly and forth to a receiver 244 to be received. But if there is slurry flowing in the air line, the light emitted by the sensor 240 from the emitter 242 will refract when goes through slurry, and makes the receiver 244 undeceived. (As illustrated in FIG.6) When the situation happens, sensor 240 will send a signal to the control system of the improved chemical mechanical polishing apparatus 20 to make related parts stop operating to prevent the unpolished wafer 218 from slipping out the wear ring 216 and break.

Of course, the mode of sensor is not limited to light passing function; it also can be light refraction sensor, radiation sensor or any other that can recognize the air and liquid. Besides, sensor also can be install on any air line of the improved chemical mechanical polishing apparatus.

Although specific embodiments have been illustrated and described, it will be obvious to those skilled in the art that various modifications may be made without departing from what is intended to be limited solely by the appended claims.

What is claimed is:

1. An improved chemical mechanical polishing apparatus, comprising:

a wafer head, which is used to place an unpolished wafer;

a polish head, which is provided to transit polish slurry to the surface of said wafer;

a damper having a damper air inlet and a damper air outlet wherein a velocity of air through said damper air outlet is slower than said velocity of air through said damper air inlet, which is linked to a polish air inlet of said polish head for reducing an air sharp pressure curve; and a sensor, which is linked to an air inlet or outlet of said damper for detecting whether there is an unusual air flow.

2. The improved chemical mechanical polishing apparatus in accordance with claim 1, wherein said damper comprises:

said damper air inlet with a first radius;

said damper air outlet with a second radius, wherein said second radius is greater than said first radius; and air temporary storage machine used to temporarily storage flowing air for reducing said air sharp pressure curve.

3. The improved chemical mechanical polishing apparatus in accordance with claim 1, wherein said sensor comprising:

an emitter, which is used to emit a detecting light in a straight line; and a receiver, which is placed on a straight line axis with said emitter for receiving said detecting light.

4. The improved chemical mechanical polishing apparatus in accordance with claim 3, wherein said sensor sends a signal to a control system of said chemical mechanical polishing apparatus to stop operating automatically when a flowing liquid is detected.

5. The improved chemical mechanical polishing apparatus in accordance with claim 1, wherein said sensor is a passage sensor.

6. The improved chemical mechanical polishing apparatus in accordance with claim 1, wherein said sensor is a reflection sensor.

7. The improved chemical mechanical polishing apparatus in accordance with claim 1, wherein said sensor is a radiation sensor.

8. An improved chemical mechanical polishing apparatus, comprising:

a wafer head, which is used to place an unpolished wafer;

a polish head, which is provided to transit a polish slurry to a surface of said unpolished wafer;

a damper, which is linked to an air inlet path of said polish head for reducing an air sharp pressure curve, wherein said damper comprises:

a damper air inlet with a first radius;

a damper air outlet with a second radius, wherein said second radius is greater than said first radius; and air temporary storage machine used to temporarily store flowing air for reducing said sharp pressure curve;

a sensor, which is linked to said air inlet or outlet of said damper for detecting whether there is an unusual flowing liquid.

9. The improved chemical mechanical polishing apparatus in accordance with claim 8, wherein said sensor comprises:

an emitter, which is used to emit a detecting light in a straight line; and a receiver, which is placed on a straight line axis with said emitter for receiving said detecting light.

10. The improved chemical mechanical polishing apparatus in accordance with claim 9, wherein said sensor sends a signal to a control system of said chemical mechanical polishing apparatus to stop operating automatically when a flowing liquid is detected.

11. The improved chemical mechanical polishing apparatus in accordance with claim 8, wherein said sensor is a passage sensor.

12. The improved chemical mechanical polishing apparatus in accordance with claim 8, wherein said sensor is a reflection sensor.

13. The improved chemical mechanical polishing apparatus in accordance with claim 8, wherein said sensor is a radiation sensor.

* * * * *